US008052256B2

(12) United States Patent
Nakamura et al.

(10) Patent No.: US 8,052,256 B2
(45) Date of Patent: Nov. 8, 2011

(54) LIQUID DISCHARGE DEVICE

(75) Inventors: Hirotake Nakamura, Nagoya (JP); Takaichiro Umeda, Nagoya (JP)

(73) Assignee: Brother Kogyo Kabsuhiki Kaisha, Aichi-Ken (JP)

( * ) Notice: Subject to any disclaimer, the term of this patent is extended or adjusted under 35 U.S.C. 154(b) by 862 days.

(21) Appl. No.: 12/005,472

(22) Filed: Dec. 27, 2007

(65) Prior Publication Data

US 2008/0158310 A1 Jul. 3, 2008

(30) Foreign Application Priority Data

Dec. 29, 2006 (JP) ..... 2006-356792

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85, 86, 87
See application file for complete search history.

(56) References Cited

U.S. PATENT DOCUMENTS 5,963,237 A 10/1999 Ikkatai et al.
6,022,102 A 2/2000 Ikkatai et al.
6,276,784 B1 8/2001 Ikkatai et al.
6,390,611 B1 5/2002 Kobayashi et al.
6,868,372 B2 3/2005 Cuttner et al.
6,966,641 B2 * 11/2005 Taniguchi et al. ..... 347/86
6,991,325 B2 1/2006 Oda et al.
2003/0038865 A1 2/2003 Inamura
2005/0212874 A1 9/2005 Nomura et al.
2006/0028519 A1 * 2/2006 Nakamura et al. ..... 347/87
2006/0170739 A1 8/2006 Koga et al.
2007/0115329 A1 5/2007 Takatsuka

FOREIGN PATENT DOCUMENTS

JP 10-029318 2/1998

(Continued)

OTHER PUBLICATIONS

U.S. Appl. No. 12/005,724, filed Dec. 28, 2007, Bro. Kogyo Kabushiki Kaisha.

(Continued)

*Primary Examiner* — Matthew Luu
*Assistant Examiner* — Jannelle M Lebron
(74) *Attorney, Agent, or Firm* — Frommer Lawrence & Haug LLP

(57) ABSTRACT

A liquid discharge device may be provided with a transferring device, a discharge head, a tank, a liquid replenishment device, and a member. The transferring device transfers a recording medium along a feeding path. The discharge head is capable of moving along a movement path. The movement path is disposed above the feeding path. The discharge head comprises a nozzle for discharging liquid toward the recording medium transferred by the transferring device. The tank is capable of moving along the movement path with the discharge head. The tank comprises a liquid inlet hole and a liquid outlet hole. The tank is capable of storing liquid replenished from the liquid inlet hole. The liquid within the tank is to be supplied to the discharge head via the liquid outlet hole. The liquid replenishment device is capable of being connected to and disconnected from the tank. The liquid is supplied to the tank when the liquid replenishment device is in a connected state with the tank. The member is disposed between the feeding path and the movement path along a vertical direction. The member is configured to receive liquid falling from the liquid inlet hole of the tank.

11 Claims, 11 Drawing Sheets

FOREIGN PATENT DOCUMENTS

| | | |
|---|---|---|
| JP | 10-309806 | 11/1998 |
| JP | 2000-343722 | 12/2000 |
| JP | 2002-154218 | 5/2002 |
| JP | 2002-361894 | 12/2002 |
| JP | 2003/053996 | 2/2003 |
| JP | 2003127411 | 5/2003 |
| JP | 2006-205690 | 8/2006 |

OTHER PUBLICATIONS

U.S. Appl. No. 12/005,988, filed Dec. 28, 2007, Brother Kogyo Kabushiki Kaisha.

U.S. Appl. No. 12/005,758, filed Dec. 28, 2007, Bro. Kogyo Kabushiki Kaisha.

* cited by examiner

LIQUID DISCHARGE DEVICE

CROSS-REFERENCE TO RELATED APPLICATION

This application claims priority to Japanese Patent Application No. 2006-356792, filed on Dec. 29, 2006, the contents of which are hereby incorporated by reference into the present application.

BACKGROUND OF THE INVENTION

1. Field of the Invention

The technique taught in the present specification relates to a liquid discharge device comprising a tank which moves with a discharge head. The liquid discharge device records an image onto a recording medium by discharging liquid from the discharge head. In particular, the technique relates to a liquid discharge device comprising a liquid replenishment device that can be connected to and disconnected from the tank, and that replenishes liquid into the tank while the tank is in a connected state with the liquid replenishment device.

2. Description of the Related Art

An ink jet printer that comprises a tank which moves with a discharge head is taught in, for example, US Patent Application Publication No. 2006/170739. The tank comprises an ink inlet hole for replenishing the ink. The ink jet printer comprises an ink replenishment device that can be connected to the ink inlet hole of the tank. The ink replenishment device replenishes ink into the tank while the ink replenishment device is in a connected state with the ink inlet hole. When the ink has been replenished into the tank, the ink replenishment device is disconnected from the ink inlet hole of the tank.

BRIEF SUMMARY OF THE INVENTION

After a liquid replenishment device has been disconnected from a liquid inlet hole of a tank, liquid may fall from the liquid inlet hole. In this case, this liquid may make contact with a recording medium. The present specification teaches a technique for preventing liquid falling from the liquid inlet hole of the tank from making contact with the recording medium.

One technique taught in the present specification is a liquid discharge device. This liquid discharge device may comprise a transferring device, a discharge head, a tank, and a liquid replenishment device. The transferring device transfers a recording medium along a feeding path. The discharge head is capable of moving along a movement path. The movement path is disposed above the feeding path. The discharge head comprises a nozzle for discharging liquid toward the recording medium transferred by the transferring device. The tank is capable of moving along the movement path with the discharge head. The tank comprises a liquid inlet hole and a liquid outlet hole. The tank is capable of storing liquid replenished from the liquid inlet hole. The liquid within the tank is to be supplied to the discharge head via the liquid outlet hole. The liquid replenishment device is capable of being connected to and disconnected from the tank. Liquid is to be supplied to the tank when the liquid replenishment device is in a connected state with the tank. The liquid discharge device may comprise a member disposed along a vertical direction between the feeding path and the movement path. The member is configured to receive liquid falling from the liquid inlet hole of the tank. With this configuration, liquid falling from the liquid inlet hole of the tank can be preventing from making contact with the recording medium.

DETAILED DESCRIPTION OF THE PREFERRED EMBODIMENTS

First Embodiment

Figure 1:
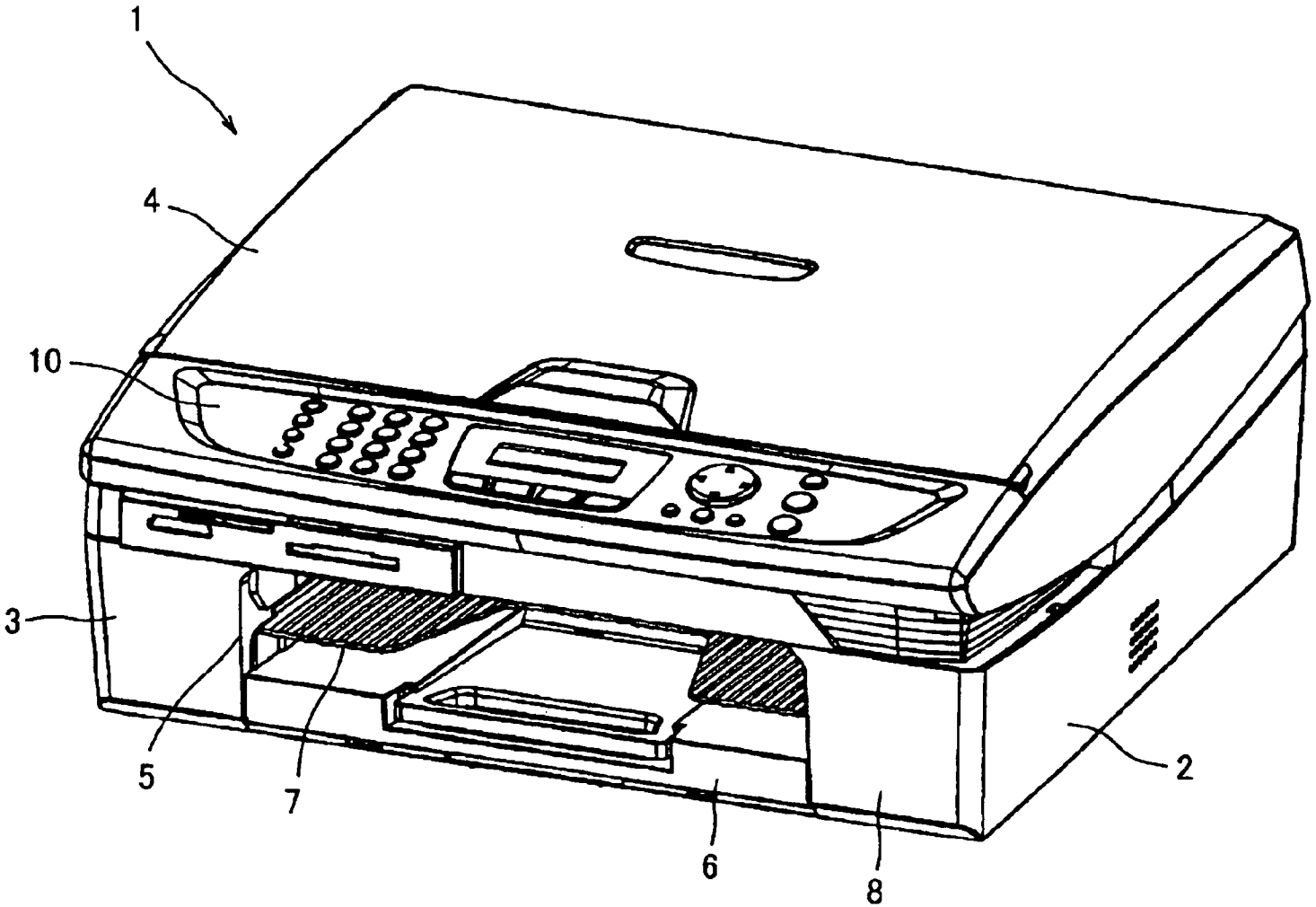
FIG. 1 shows a perspective view of a multi function device provided with an ink jet recording device.

FIG. 1 shows a perspective view of a multi function device 1 provided with an ink jet recording device 3. The multi function device 1 has a printer function, scanner function, copy function, and facsimile function. The multi function device 1 has a casing 2, the ink jet recording device 3 disposed within a lower part of the casing 2, and a scanner device 4 disposed within an upper part of the casing 2. An opening 5 is formed in a front surface of the casing 2. A paper supply tray 6 of the ink jet recording device 3 is disposed in a lower part of the opening 5. A paper discharge tray 7 of the ink jet recording device 3 is disposed in an upper part of the opening 5. An opening and closing cover 8 is formed at a lower right side of a front surface side of the ink jet recording device 3. A main tank mounting part 9 (see FIG. 3) is formed at an inner side of the opening and closing cover 8. An operation panel 10 for operating the ink jet recording device 3, the scanner device 4, etc. is formed at an upper part of a front surface side of the multi function device 1. Further, in the case where an external computer is connected, the multi function device 1 is capable of operating on the basis of commands transmitted from the computer via a driver.

Figure 2:
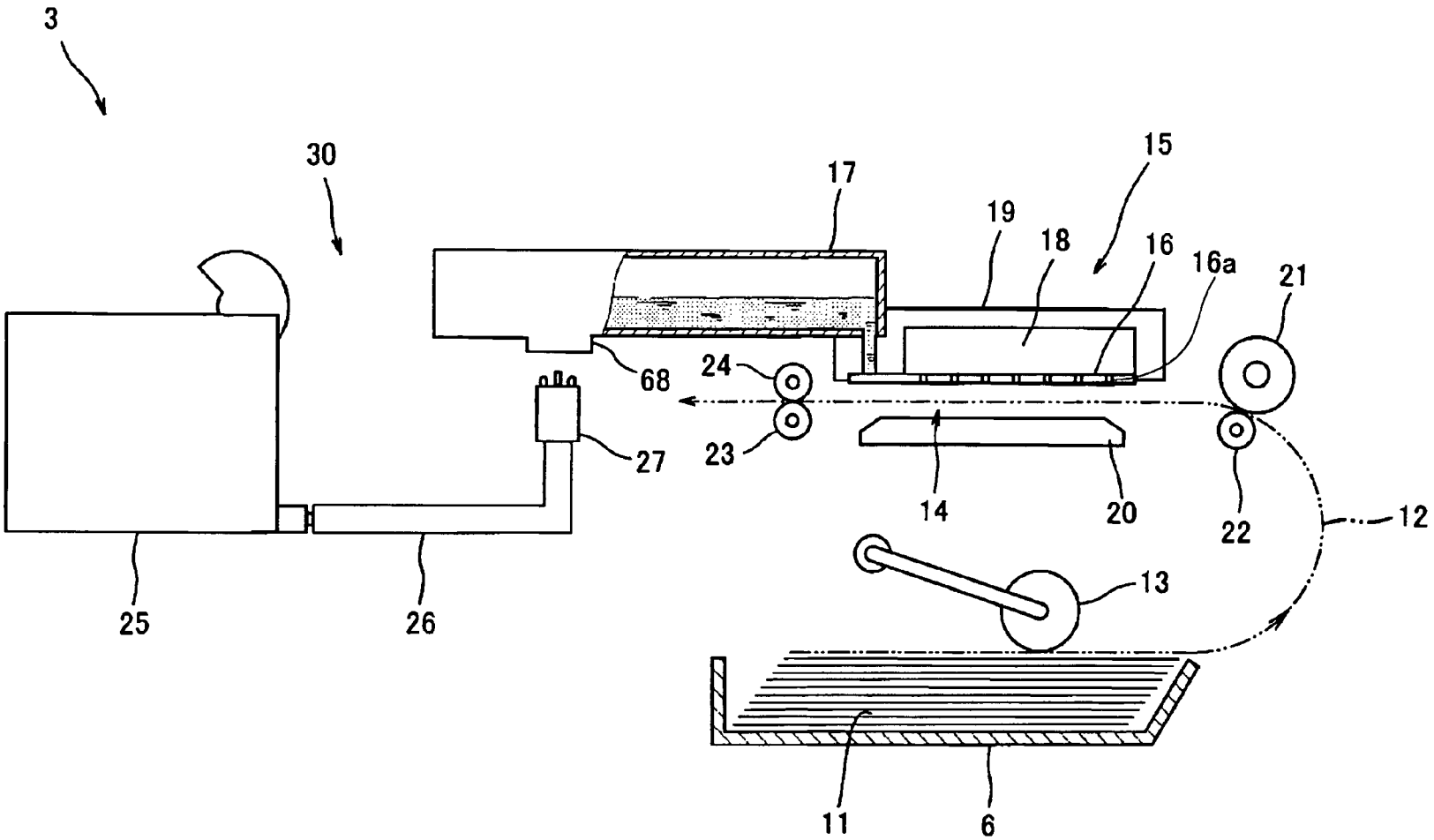
FIG. 2 shows a schematic cross-sectional view of the ink jet recording device.

FIG. 2 shows a schematic cross-sectional view of the ink jet recording device 3. The paper supply tray 6 is disposed at a bottom side of the multi function device 1. A paper supply driving roller 13 is disposed at an upper side of the paper supply tray 6. The paper supply driving roller 13 supplies an uppermost sheet of paper 11 stacked in the paper supply tray 6 to a feeding path 12. The feeding path 12 extends upwards from a back surface side of the paper supply tray 6 and then forms a U-turn to face toward a front surface side thereof. The feeding path 12 passes a printing region 14 and extends to the paper discharge tray 7 (see FIG. 1). The paper 11 is fed in a horizontal direction from the printing region 14 to the paper discharge tray 7. That is, the feeding path 12 extends along a horizontal plane.

An image recording unit 15 is disposed in the printing region 14. A platen 20 that is larger than the paper size is disposed below the image recording unit 15. A feeding roller 21 and a pinch roller 22 are disposed at an upstream side of the image recording unit 15 along a paper transportation direction. The rollers 21 and 22 feed the paper 11 toward the platen 20. A paper discharge roller 23 and a pinch roller 24 are disposed at a downstream side of the image recording unit 15 along the paper transportation direction. The rollers 23 and 24 feed the paper 11 that has had an image printed thereon toward the paper discharge tray 7 (see FIG. 1).

The image recording unit 15 comprises a discharge head 16, a sub tank 17, a head controlling substrate 18, and a carriage 19. The discharge head 16 has a plurality of nozzle holes 16*a*. The discharge head 16 discharges ink towards the platen 20 from the nozzle holes 16*a*. The discharge head 16 may be a commonly known piezoelectric driven type. The sub tank 17 stores ink to be supplied to the discharge head 16. The head controlling substrate 18 controls the operation of the discharge head 16. The discharge head 16, sub tank 17, and head controlling substrate 18 are mounted on the carriage 19.

The sub tank 17 has a first joint part 68. The ink jet recording device 3 is provided with an ink replenishment mechanism 30. The first joint part 68 can be connected with the ink replenishment mechanism 30. Ink can be replenished into the sub tank 17 when the first joint part 68 and the ink replenishment mechanism 30 are in a connected state. The ink replenishment mechanism 30 is provided with a main tank 25, an ink supply tube 26, and a second joint part 27. The main tank 25 is housed detachably in the main tank mounting part 9 shown in FIG. 3. The main tank 25 is a cartridge type. One end of the ink supply tube 26 is connected with the main tank 25. The other end of the ink supply tube 26 is connected with the second joint part 27. The second joint part 27 is capable of moving in a vertical direction. The second joint part 27 is thus attached to and detached from the first joint part 68 of the sub tank 17. The second joint part 27 is connected to the first joint part 68 when the second joint part 27 is raised. In this state, the main tank 25 communicates with the sub tank 17 via the ink supply tube 26. That is, an ink replenishment path 26, 27*b*, 72 is in a connected state.

Figure 3:
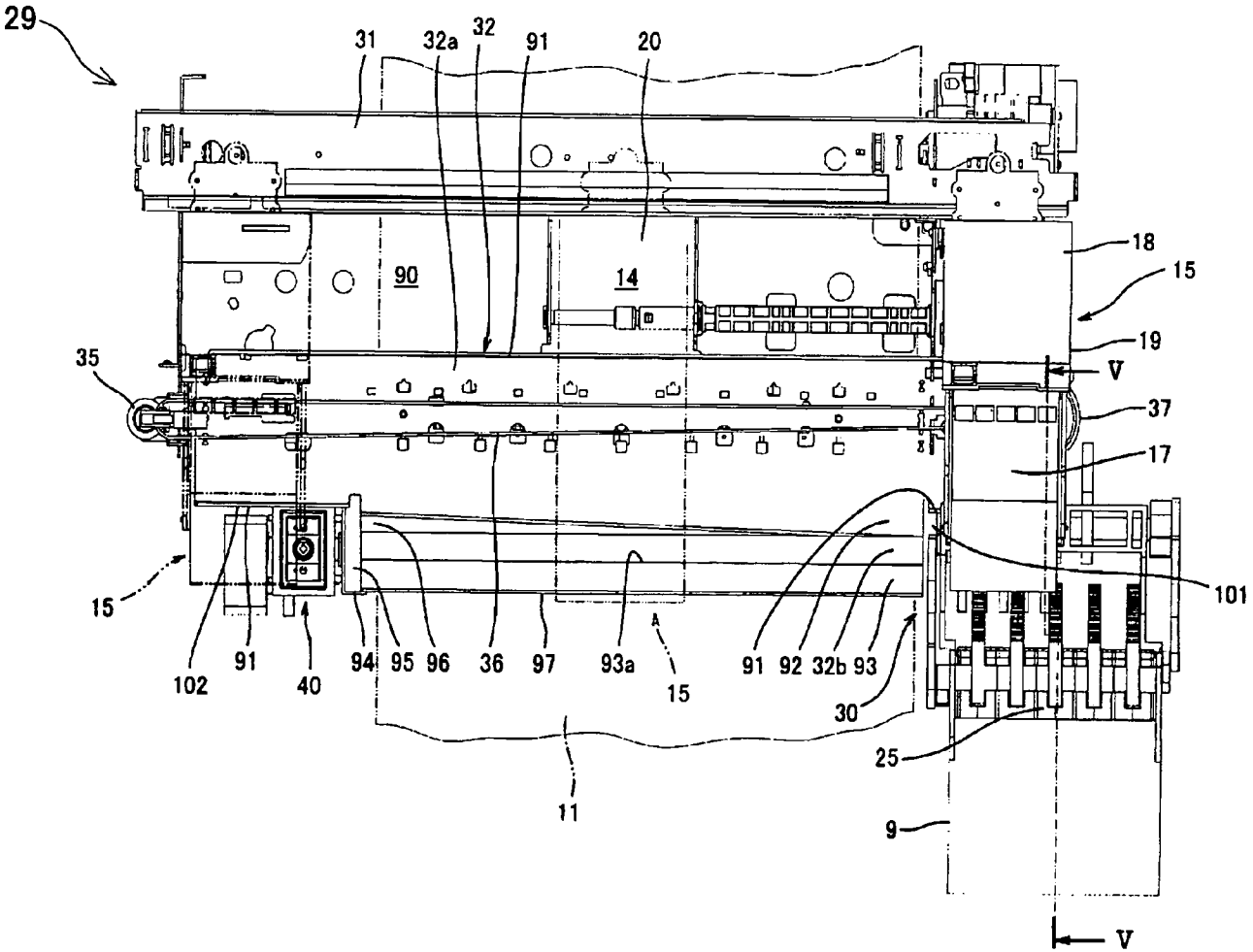
FIG. 3 shows a plan view of the ink jet recording device.

FIG. 3 shows a plan view of the ink jet recording device 3. A frame 29 is disposed above the platen 20. The frame 29 comprises a pair of guide rails 31, 32. The guide rails 31 and 32 have a flat plate shape. The guide rails 31 and 32 extend along a scanning direction that is orthogonal to a paper transferring direction (the up-down direction in FIG. 3). The guide rails 31 and 32 are formed on substantially the same plane. Upper surfaces of the guide rails 31 and 32 are substantially parallel to an upper surface of the platen 20, and are formed so as to be horizontal. A space 90 is formed between the guide rail 31 and the guide rail 32. The space 90 extends along the scanning direction. The discharge head 16 moves above the space 90. The guide rails 31 and 32 support the carriage 19 of the image recording unit 15. The carriage 19 is capable of sliding in the direction in which the guide rails 31 and 32 extend (the left-right direction in FIG. 3).

The guide rail 32 comprises a guide rail main body 32*a* and a cover part 32*b*. The guide rail main body 32*a* extends along the scanning direction. A driving pulley (not shown) and a driven pulley 35 are disposed at an upper surface of the guide rail main body 32*a*. The driving pulley is disposed at one end part thereof in the scanning direction. The driven pulley 35 is disposed at the other end part thereof in the scanning direction. A ring shaped timing belt 36 is hung between the driving pulley and the driven pulley 35. A bottom part of the carriage 19 is fixed to a part of the timing belt 36. A motor 37 is connected to an axis of the driving pulley. The motor 37 causes the driving pulley to rotate. The timing belt 36 consequently rotates between the driving pulley and the driven pulley 35. When the timing belt 36 rotates, the carriage 19 moves along the guide rails 31 and 32. The carriage 19 can be made to move back and forth along the guide rails 31 and 32 by changing the direction of rotation of the motor 37. When the carriage 19 moves, the members mounted therein (the discharge head 16, the sub tank 17, and the head controlling substrate 18) move integrally with the carriage 19. A movement path of the carriage 19 (that is, a movement path of the discharge head 16, the sub tank 17, and the head controlling substrate 18) is located above the feeding path 12 of the paper 11 (see FIG. 3).

Figure 4:
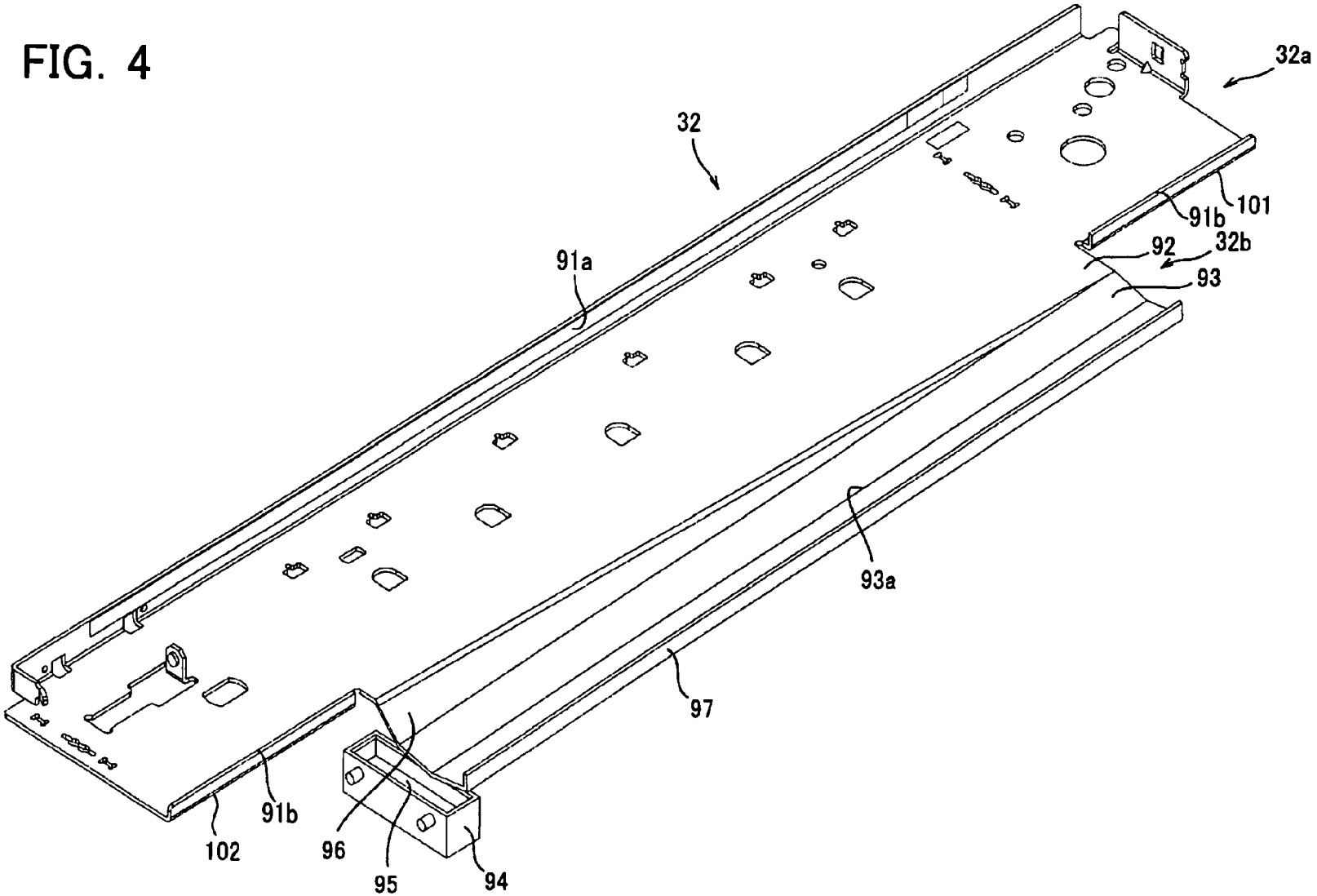
FIG. 4 shows a perspective view of a guide rail.

FIG. 4 shows a perspective view of the guide rail 32. Substantially all of a peripheral end part, at an upstream side in the paper transferring direction, of the guide rail main body 32*a* extends upward. Below, the portion that is extending upward will be termed a rising part 91*a*. Further, a portion of a peripheral end part, at a downstream side in the paper transferring direction, of the guide rail main body 32*a* extends upward. Below, this portion that is extending upward will be termed a rising part 91*b*. The rising part 91*b* is formed at one end side and the other end side in the scanning direction. That is, the rising part 91*b* is not formed in a central part in the scanning direction. The cover part 32*b* is coupled to the portion where the rising part 92*b* is not formed. The cover part 32*b* is not coupled to the portion where the rising part 92*b* is formed. As a result, the guide rail 32 has notches 101 and 102. The first of these notches 101 is formed at one end side in the scanning direction. The other of these notches 102 is formed at the other end side in the scanning direction. Moreover, the cover part 32*b* is formed integrally with the guide rail main body 32*a*.

As is clear from FIG. 3, the cover part 32*b* is disposed so as to cover, from above, the printing region 14 through which the paper 11 passes. That is, from a plan view of the ink jet recording device 3, the cover part 32*b* overlaps with the feeding path 12 of the paper 11. Further, from the plan view of the ink jet recording device 3, the cover part 32*b* overlaps with substantially all of a movement range of the first joint part 68 (specifically with an inlet hole 68*c* (to be described)). That is, in the case where the sub tank 17 is located in the position shown in FIG. 3, the cover part 32*b* and the first joint part 68 (the inlet hole 68*c*) do not overlap. However, when the sub tank 17 moves to the left from the position shown in FIG. 3, the cover part 32*b* and the first joint part 68 (the inlet hole 68*c*) overlap. Furthermore, in a vertical direction of the ink jet recording device 3, the cover part 32*b* is disposed between the movement path of the sub tank 17 and the feeding path 12 of the paper 11 (i.e. between the first joint part 68 and the paper 11). The cover part 32*b* comprises a flat part 92 and a guiding plate 93. The flat part 92 extends along the scanning direction. The flat part 92 extends in a downstream direction, in the paper transferring direction, from the guide rail main body 32*a*. An upper surface of the flat part 92 is present on the same plane as the upper surface of the guide rail main body 32*a*. The guiding plate 93 extends downstream, in the paper transferring direction, from the flat part 92.

The guiding plate 93 has a plate shape that extends in the scanning direction. In cross-section (a cross-section orthogonal to the scanning direction), the guiding plate 93 is formed in a V shape. From the plan view of the ink jet recording device 3, the guiding plate 93 is disposed at a position that faces the first joint part 63 while the first joint part 63 is moving. The guiding plate 93 slants downward from one end part in the scanning direction (the right end part of FIG. 4) to the other end part in the scanning direction (the left end part of FIG. 4). An ink storage tank 94 is connected with the other end part in the scanning direction of the guiding plate 93. The ink storage tank 94 has a box shape that opens upward. An ink absorbing body 95 is disposed within the ink storage tank 94. An upstream end part, in the paper transferring direction, of the guiding plate 93 communicates with the flat part 92 via a slant portion 96. A peripheral end part of the guiding plate 93 that is downstream in the paper transferring direction extends upward. Below, the portion that is extending upward will be termed a rising part 97.

The cover part 32*b* is capable of receiving (catching) ink that has fallen from the sub tank 17 (the inlet hole 68*c*). This ink may be caught by the guiding plate 93, and may be led along a peak portion 93*a* of the guiding plate 93. The ink flows along the guiding plate 93 from the one end part in the scanning direction to the other end part thereof. When the ink reaches the other end part, it is led into the ink storage tank 94 and absorbed by the ink absorbing body 95. The ink may be prevented from remaining on the cover part 32*b*.

Ink that has fallen from the sub tank 17 may rebound when it makes contact with the guiding plate 93. In the present embodiment, the guiding plate 93 is formed in a V shape in cross-section, and consequently ink is prevented from rebounding to a high position. Since the rising part 97 is present, ink is prevented from dispersing to the exterior of the cover part 32*b* even if the ink were to rebound. Ink that has made contact with the rising part 97 is also led along the guiding plate 93 to the ink storage tank 94 and is absorbed by the ink absorbing body 95.

The ink replenishment mechanism 30 and a maintenance mechanism 40 are disposed at an outer side of the printing region which the paper passes. The ink replenishment mechanism 30 is disposed in the one notch 101 (the notch 101 at the right side in FIG. 3). The maintenance mechanism 40 is disposed in the other notch 102 (the notch 102 at the left side in FIG. 3). The ink replenishment mechanism 30 comprises the main tank mounting part 9. The main tank mounting part 9 is capable of housing five main tanks 25 corresponding to the five colors of ink.

In the case where the ink replenishment mechanism 30 is replenishing ink into the sub tank 17, and in the case where the maintenance mechanism 40 is performing maintenance on the discharge head 16, the cover part 32*b* does not obstruct these operations.

Figure 5:
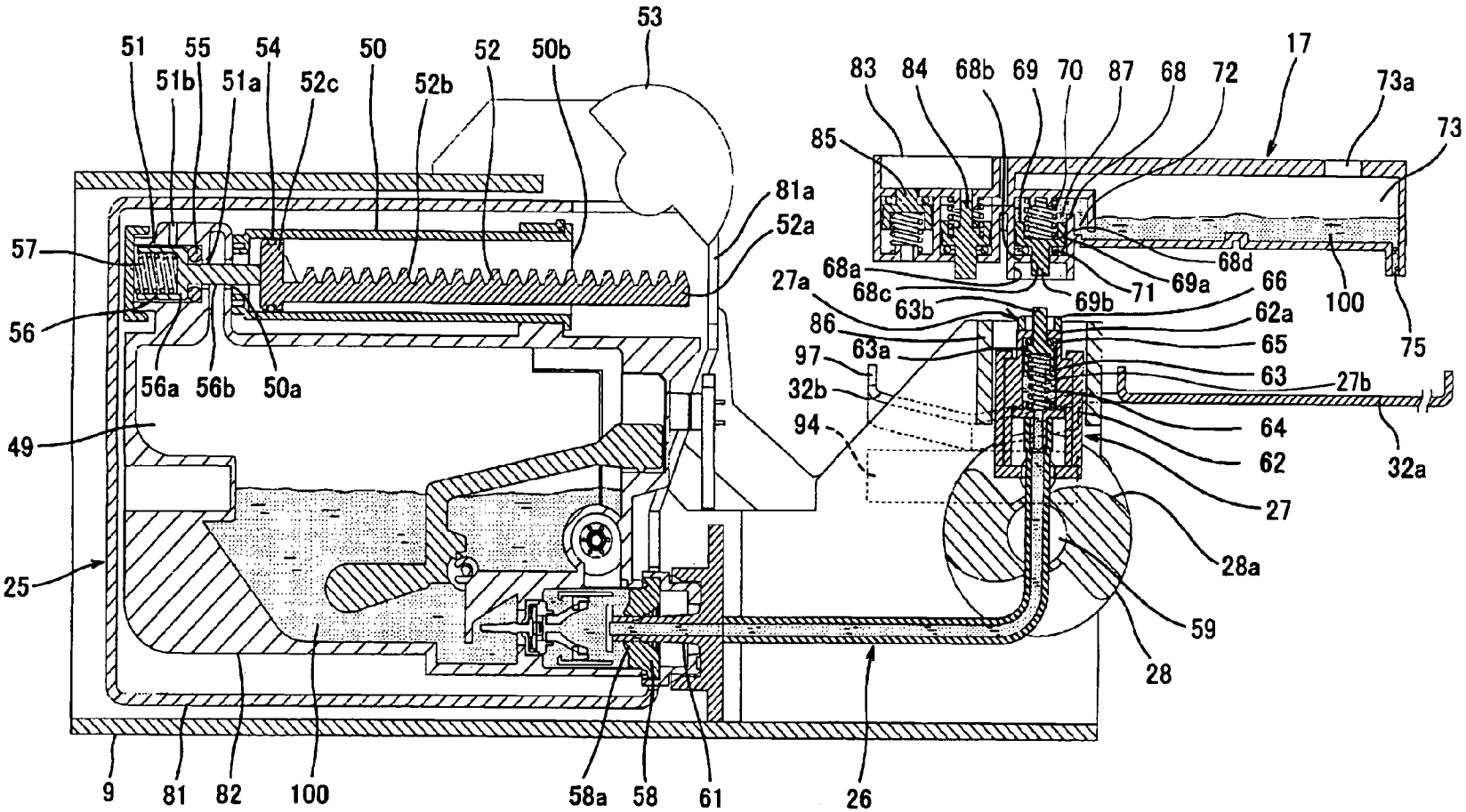
FIG. 5 shows a cross-sectional view along the line V-V of FIG. 3. An ink replenishment path is in a disconnected state.

FIG. 5 shows a cross-sectional view along the line V-V of FIG. 3. The main tank 25 has an outer case 81 and an inner case 82. The inner case 82 has an ink storage chamber 49 that stores ink 100. A piston pump chamber 50 and a positive pressure controlling chamber 51 are disposed above the ink storage chamber 49. The piston pump chamber 50 is disposed at the right side, and the positive pressure controlling chamber 51 is disposed at the left side. The piston pump chamber 50 communicates with an air layer in a top part of the ink storage chamber 49. A piston 52 is inserted into the piston pump chamber 50 in a manner capable of moving back and forth. The piston 52 comprises a rod part 52*a*, a rack gear part 52*b*, and a piston part 52*c*. The rod part 52*a* has a smaller diameter than the piston pump chamber 50. The rack gear part 52*b* is formed on an upper surface of the rod part 52*a*. The piston part 52*c* is disposed at a left end part of the rod part 52*a*. An O ring 54 is attached to the piston part 52*c*. The O ring 54 makes contact with an inner circumference surface of the piston pump chamber 50. Gas is consequently unable to pass between a right side and a left side of the O ring 54.

An insertion hole 50*a* and an opening part 50*b* are formed in the piston pump chamber 50. The insertion hole 50*a* is formed in a wall surface facing the positive pressure controlling chamber 51. The opening part 50*b* is formed in a wall surface at the other side from the insertion hole 50*a*. The opening part 50*b* allows the rod part 52*a* to pass therethrough. An opening part 81*a* is formed in the outer case 81. The opening part 81*a* is formed by making a notch in a wall surface of a sub tank side of the outer case 81. The opening part 81*a* is formed in a region corresponding to the opening part 50*b* of the piston pump chamber 50. Furthermore, a substantially half-circle shaped pinion gear 53 is disposed at an upper part of the main tank mounting part 9. The pinion gear 53 is driven to rotate by a driving means (not shown). The pinion gear 53 passes through the opening part 81*a* and meshes with the rack gear part 52*b*. That is, when the pinion gear 53 rotates, power is transmitted to the rack gear part 52*b*. The piston 52 can thus move back and forth.

A positive pressure controlling valve 56 is inserted into the positive pressure controlling chamber 51. The positive pressure controlling valve 56 is capable of moving back and forth in a left-right direction. The positive pressure controlling valve 56 comprises a base part 56*a* and a shaft part 56*b*. There is a clearance between the base part 56*a* and an inner circumference surface of the positive pressure controlling chamber 51. This clearance allows communication between the left side and the right side of the base part 56*a*. The shaft part 56*b* protrudes from the base part 56*a* toward the piston 52. A first atmosphere communication hole 51*a* is formed in the positive pressure controlling chamber 51. The first atmosphere communication hole 51*a* is formed in a wall surface facing the piston pump chamber 50. The first atmosphere communication hole 51*a* allows the shaft part 56*b* to pass therethrough. There is a clearance, in the first atmosphere communication hole 51*a*, between the shaft part 56*b* and the positive pressure controlling chamber 51. Further, the shaft part 56*b* passes through the insertion hole 50*a*. There is a clearance, in the insertion hole 50*a*, between the shaft part 56*b* and the piston pump chamber 50. A sealing ring 55 is attached to an inner surface of the positive pressure controlling chamber 51. The sealing ring 55 is disposed between the base part 56*a* and the wall facing the piston pump chamber 50. A coiled spring 57 makes contact with the base part 56*a* of the positive pressure controlling valve 56. The coiled spring 57 biases the base part 56*a* toward the sealing ring 55. Further, a second atmosphere communication hole 51*b* is formed in the positive pressure controlling chamber 51. The second atmosphere communication hole 51*b* is formed in an upper wall surface of the positive pressure controlling chamber 51. The sealing ring 55 is present between the first atmosphere communication hole 51*a* and the second atmosphere communication hole 51*b*. In a normal state there is no communication between the first atmosphere communication hole 51*a* and the second atmosphere communication hole 51*b* because the sealing ring 55 creates a seal between the base part 56*a* and the inner circumference surface of the positive pressure controlling chamber 51.

In the case where positive pressure equal to or above a predetermined value is generated in the ink storage chamber 49, the positive pressure controlling valve 56 separates from the sealing ring 55 against the biasing force of the coiled spring 57. The first atmosphere communication hole 51*a* and the second atmosphere communication hole 51*b* thus communicate. In this case, the ink storage chamber 49 communicates with the atmosphere via the first atmosphere communication hole 51*a* and the second atmosphere communication hole 51*b*. Further, the positive pressure controlling valve 56 separates from the sealing ring 55 against the biasing force of the coiled spring 57 even in the case where the piston 52 moves toward the positive pressure controlling chamber 51 and presses the shaft part 56*b*. In this case, as well, the first atmosphere communication hole 51*a* and the second atmosphere communication hole 51*b* communicate, and the ink storage chamber 49 communicates with the atmosphere.

A tube connecting part 58 capable of deforming elastically is disposed at a lower part of the main tank 25. The tube connecting part 58 has a ring shape. An ink hole 58*a* is formed in a center of the tube connecting part 58. The tube connecting part 58 contracts due to resilient force when there is no load, thus closing the ink hole 58*a*. A connecting terminal 61 is connected to one end part of the ink supply tube 26. The connecting terminal 61 is inserted into the tube connecting part 58. The ink supply tube 26 thus communicates with the ink storage chamber 49 of the main tank 25. The second joint part 27 is connected to the other end part of the ink supply tube 26.

A tip part 27*a* of the second joint part 27 is disposed above the guide rail 32. The second joint part 27 is disposed within the notch 101. The second joint part 27 has a casing 62 that communicates with the ink supply tube 26. An outlet hole 62*a* is formed in an upper wall of the casing 62. The outlet hole 62*a* is located in a position higher than an ink level within the main tank 25 even in the case where the second joint part 27 is located in its lowermost position. The positional relationship of the joint part 27 and the main tank mounting part 9 (the main tank 25) is adjusted such that the above positional relationship is achieved. A guiding cylindrical part 86 is formed integrally with the main tank mounting part 9. The casing 62 is capable of sliding in an up-down direction along an inner circumference surface of the guiding cylindrical part 86. A ring shaped sealing member 66 capable of deforming elastically is attached to an upper end surface of the casing 62. The sealing member 66 is disposed at the surroundings of the outlet hole 62*a*. A cam roller 28 is disposed below the casing 62. The cam roller 28 is connected to a driving axis 59. The driving axis 59 is connected with a driving source (not shown). When the driving axis 59 rotates, the cam roller 28 rotates in a clockwise or anti-clockwise direction. The cam roller 28 has a cam surface 28*a*. The cam surface 28*a* smoothly changes the distance in a radial direction to the driving axis 59. When the cam roller 28 rotates in an anti-clockwise direction from the state shown in FIG. 4, the cam surface 28*a* makes contact with a lower surface of the casing 62, and raises the second joint part 27. When the cam roller 28 rotates in a clockwise direction from the state where the second joint part 27 is in the raised position, the second joint part 27 descends along the cam surface 28*a*.

A second opening and closing valve 63 is inserted into the casing 62 in a manner capable of moving in the vertical direction. The second opening and closing valve 63 has a base part 63*a* and a shaft part 63*b*. There is a clearance between the base part 63*a* and an inner circumference surface of the casing 62. This clearance allows communication between an upper side and a lower side of the base part 63*a*. The shaft part 63*b* protrudes upward from the base part 63*a*. The shaft part 63*b* passes through the outlet hole 62*a*. There is a clearance, in the outlet hole 62*a*, between the shaft part 63*b* and the inner circumference surface of the casing 62. This clearance allows communication between an upper side and a lower side of the outlet hole 62*a*. A sealing ring 65 is attached to the inner circumference surface of the casing 62. The sealing ring 65 is disposed at the surroundings of the outlet hole 62*a*. The sealing ring 65 is disposed between the casing 62 and the base part 63*a* of the second opening and closing valve 63. A coiled spring 64 makes contact with the base part 63*a* of the second opening and closing valve 63. The coiled spring 64 biases the base part 63*a* toward the sealing ring 65. In a normal state (a state where the second joint part 27 is not making contact with the sub tank 17), the base part 63*a* makes contact with the sealing ring 65. An ink path 27*b* within the second joint part 27 is thus closed by the second opening and closing valve 63 because the sealing ring 65 creates a seal between the base part 63*a* and the inner circumference surface of the casing 62. The ink path 27*b* is formed in spaces between the casing 62 and the second opening and closing valve 63 (a space of the outlet hole 62*a*, a space between the sealing ring 65 and the second opening and closing valve 63, etc.). Moreover, when the base part 63*a* is making contact with the sealing ring 65, the shaft part 63*b* protrudes upward beyond the sealing member 66.

The sub tank 17 has five ink storage chambers corresponding to the five colors of ink used in printing. Further, the sub tank 17 has a capacity capable of storing an amount of ink greater than or equal to that estimated to be consumed in one printing process.

The sub tank 17 comprises the first joint part 68, an ink storage chamber 73, etc. In the case where the multi function device 1 is viewed from a plan view, the first joint part 68 is disposed in a position that corresponds to the second joint part 27. The first joint part 68 has a case part 68*d* that is formed integrally with an outer wall of the sub tank 17. An ink path 72 that includes a valve space 87 is formed within the case part 68*d*. The ink path 72 communicates with the ink storage chamber 73. An outlet hole 75 is formed in a lower wall of the sub tank 17. Ink 100 within the ink storage chamber 73 is supplied from the outlet hole 75 to the discharge head 16 (see FIG. 2). A communication hole 73*a* is formed in an upper wall of the ink storage chamber 73. The sub tank 17 has a pressure buffering chamber 83. The pressure buffering chamber 83 is disposed at a left side of the first joint part 68. A resin film (not shown) is applied to the pressure buffering chamber 83 and an upper surface of the ink storage chamber 73. The pressure buffering chamber 83 and the ink storage chamber 73 thus maintain an airtight state. The pressure buffering chamber 83 communicates with the ink storage chamber 73 via a gas path (not shown) that reaches the communication hole 73*a*. The pressure buffering chamber 83 has a negative pressure controlling valve 84 and a positive pressure controlling valve 85. In the case where negative pressure equal to or above a predetermined value has occurred in the pressure buffering chamber 83, the negative pressure controlling valve 84 causes the pressure buffering chamber 83 to communicate with the atmosphere. In the case where positive pressure equal to or above a predetermined value has occurred in the pressure buffering chamber 83, the positive pressure controlling valve 85 causes the pressure buffering chamber 83 to communicate with the atmosphere.

An ink inlet hole 68*a* is formed in a lower wall of the case part 68*d*. The ink inlet hole 68*a* opens downward. The ink inlet hole 68*a* faces the cover part 32*b* (more specifically, the guiding plate 93) while the image recording unit 15 is scanning. The case part 68*d* comprises a flange part 68*b* that extends in a radial direction at an inner side. The valve space 87 is formed above the flange part 68*b*, and the ink inlet hole 68*a* is formed below the flange part 68*b*. The valve space 87 and the ink inlet hole 68*a* communicate via the inlet hole 68*c* formed at the inner side of the flange part 68*b*.

The first joint part 68 comprises the first opening and closing valve 69. The first opening and closing valve 69 is inserted into the case part 68*d*. The first opening and closing valve 69 is capable of moving in the vertical direction along the case part 68*d*. The first opening and closing valve 69 has a base part 69*a* and a shaft part 69*b*. There is a clearance between the base part 69*a* and an inner circumference surface of the case part 68*d*. This clearance allows communication between an upper side and a lower side of the base part 69*a*. Further, the shaft part 69*b* protrudes downward from the base part 69*a*. In the inlet hole 68*c* there is a clearance between the shaft part 69*b* and an inner circumference surface of the flange part 68*b*. This clearance allows communication between an upper side and a lower side of the inlet hole 68*c*.

The shaft part 69*b* of the first opening and closing valve 69 and the shaft part 63*b* of the second opening and closing valve 63 are formed on the same axis. The shaft part 69*b* and the shaft part 63*b* face one another. A sealing ring 71 is attached to the inner circumference surface of the case part 68*d*. The sealing ring 71 is disposed at the surroundings of the inlet hole 68*c*. The sealing ring 71 is disposed between the case part 68*d* and the base part 69*a* of the first opening and closing valve 69. A coiled spring 70 makes contact with the base part 69*a* of the first opening and closing valve 69. The coiled spring 70 biases the base part 69*a* toward the sealing ring 71. That is, the first opening and closing valve 69 and the second opening and closing valve 63 are biased by the coiled springs 64 and 70 in a direction of approaching one another. In the normal state (the state where the second joint part 27 is not making contact with the sub tank 17), the base part 69*a* makes contact with the sealing ring 71. The ink path 72 within the first joint part 68 is thus closed by the first opening and closing valve 69 because the sealing ring 71 creates a seal between the base part 69*a* and the inner circumference surface of the case part 68*d*. Moreover, the spring constant of the coiled spring 70 of the first joint part 68 is greater than the spring constant of the coiled spring 64 of the second joint part 27. As a result, when the shaft parts 63*b* and 69*b* strike against one another, the second opening and closing valve 63 is pushed downward by the shaft part 69*b*. That is, the ink path 27*b* of the second joint part 27 opens earlier than the ink path 72 of the first joint part 68.

Figure 6:
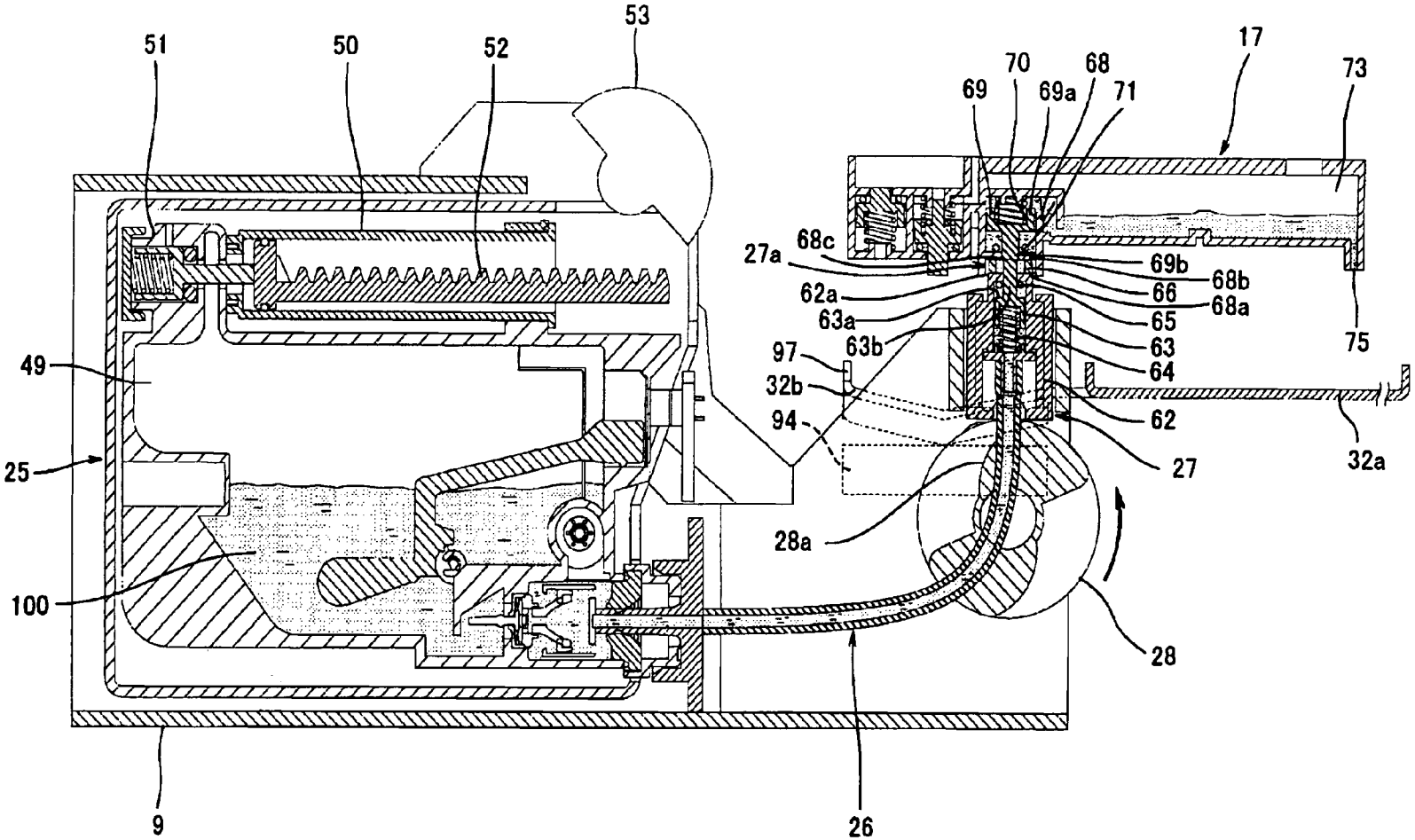
FIG. 6 shows a cross-sectional view of the ink jet recording device. The ink replenishment path is in a connected state.

Next, an ink replenishment operation will be described. FIG. 6 shows the first joint part 68 and the second joint part 27 in a connected state. FIG. 6 corresponds to the same cross-sectional view as in FIG. 5. In the case where ink is to be replenished from the main tank 25 to the sub tank 17, the image recording unit 15 moves along the guide rails 31 and 32 until the sub tank 17 is located above the notch 101 (more specifically, until the first joint part 68 is located above the second joint part 27). Next, as shown in FIG. 6, the cam roller 28 is rotated in the anti-clockwise direction, raising the second joint part 27. The sealing member 66 makes contact with the flange part 68*b* of the first joint part 68. Further, the shaft part 63*b* of the second opening and closing valve 63 strikes against the shaft part 69*b* of the first opening and closing valve 69. After the ink path 27*b* of the second joint part 27 has opened, the ink path 72 of the first joint part 68 opens. The ink path 27*b* and the ink path 72 thus communicate.

That is, the base part 63*a* of the second opening and closing valve 63 separates from the sealing ring 65 against the biasing force of the coiled spring 64, and the base part 69*a* of the first opening and closing valve 69 separates from the sealing ring 71 against the biasing force of the coiled spring 70. The main tank 27 and the sub tank 17 thus communicate with one another, and the ink replenishment path 26, 27*b*, 72 is in a connected state. The coiled springs 57 and 64 that respectively bias the positive pressure controlling valve 56 of the main tank 25 and the second opening and closing valve 63 of the second joint part 27 both have a spring constant set such that the pressure of an inner space within the main tank 25 and the ink supply tube 26 is normally maintained within a predetermined range. As a result, pressure that is transmitted from the main tank 25 via the sub tank 17 to the discharge head 16 (see FIG. 2) does not destroy the meniscus of the nozzle hole 16*a* of the discharge head 16.

Figure 7:
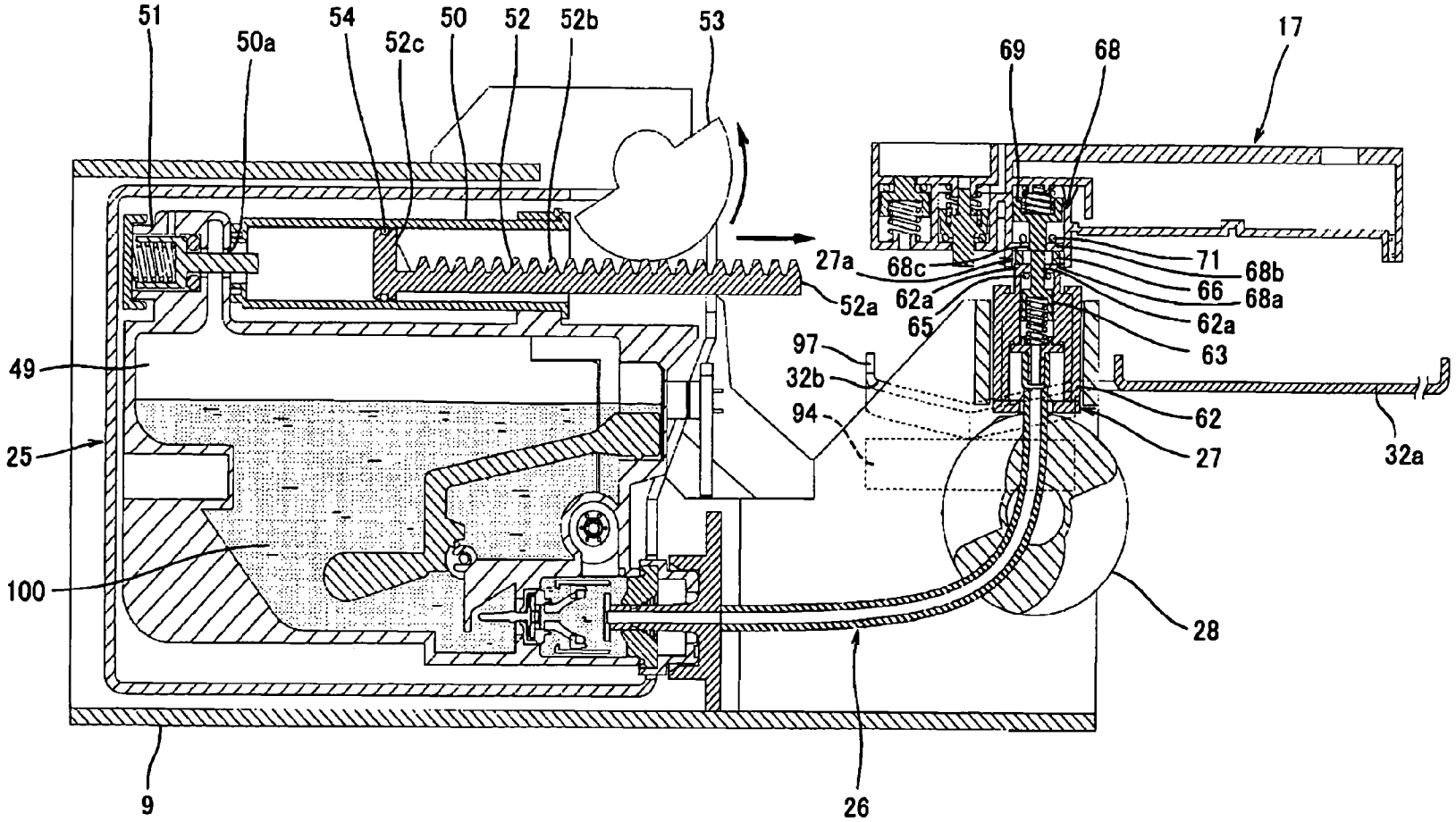
FIG. 7 shows a cross-sectional view of the ink jet recording device. A figure is shown for describing how ink returns from a sub tank to a main tank.

FIG. 7 is a figure for describing how ink returns from the sub tank 17 to the main tank 25. FIG. 7 corresponds to the same cross-section as FIG. 5. A driving source (not shown) causes the pinion gear 53 of the main tank 25 to rotate in an anti-clockwise direction. The piston 52 is thus moved away from the insertion hole 50*a*. Negative pressure is formed in the ink storage chamber 49 of the main tank 25. The ink within the sub tank 17 is sucked by this negative pressure into the main tank 25 via the ink supply tube 26.

Figure 8:
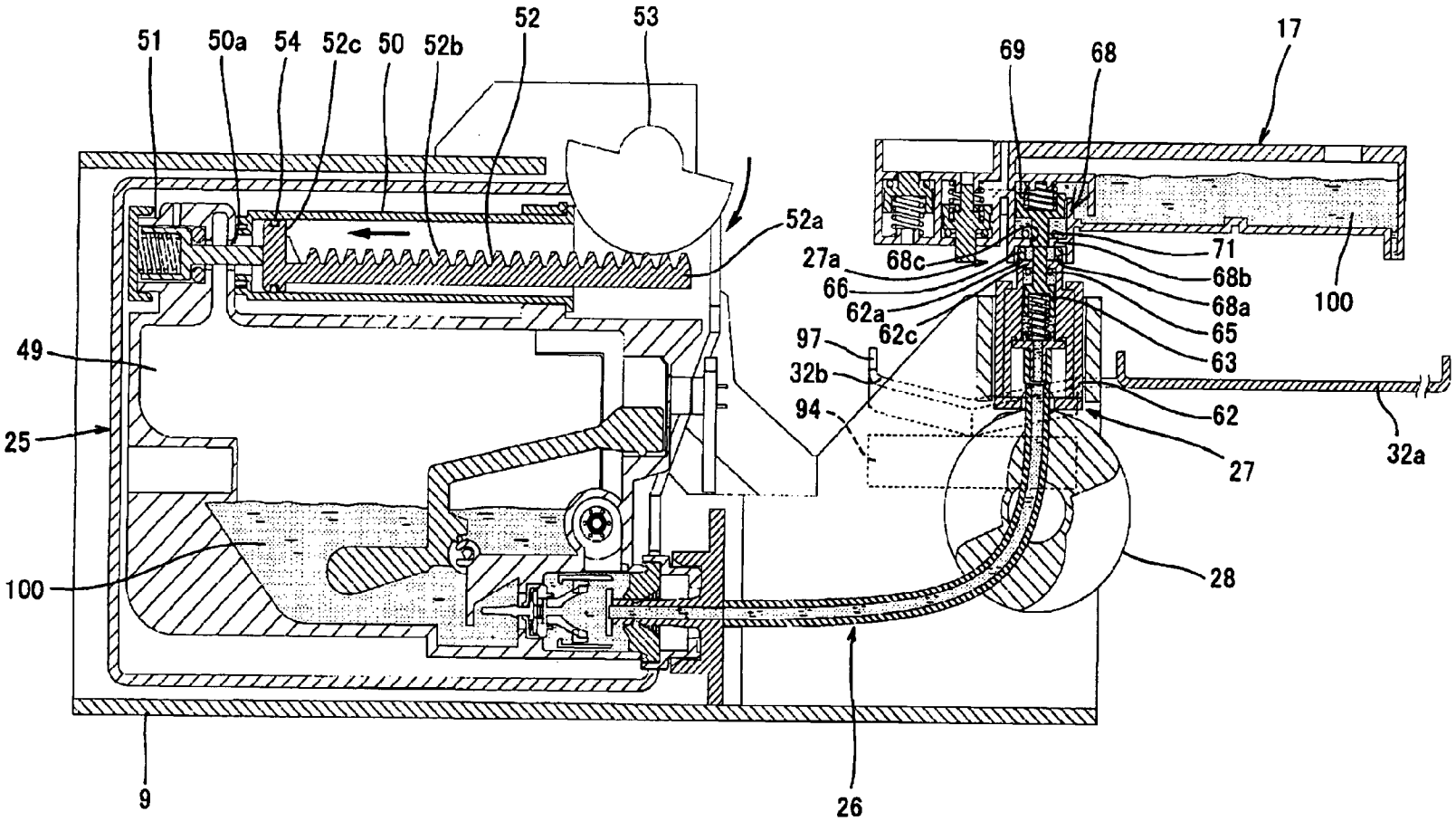
FIG. 8 shows a cross-sectional view of the ink jet recording device. A figure is shown for describing how ink is replenished from the main tank to the sub tank.

FIG. 8 is a figure for describing how ink is replenished from the main tank 25 to the sub tank 17. FIG. 8 corresponds to the same cross-section as FIG. 5. When the pinion gear 53 of the main tank 25 rotates in a clockwise direction, the piston 52 moves towards the insertion hole 50*a*. Positive pressure is formed in the ink storage chamber 49 of the main tank 25. The ink within the ink storage chamber 49 of the main tank 25 is supplied by this positive pressure to the sub tank 17 via the ink supply tube 26. The amount of ink replenished into the sub tank 17 at this juncture is set to be an amount of ink equal to or greater than the amount estimated to be consumed in the next printing operation. The piston 52 is not at a leftmost position in the state shown in FIG. 8. In this state, the sealing ring 55 is functioning, and the first atmosphere communication hole 51*a* and the second atmosphere communication hole 51*b* are not communicating.

Figure 9:
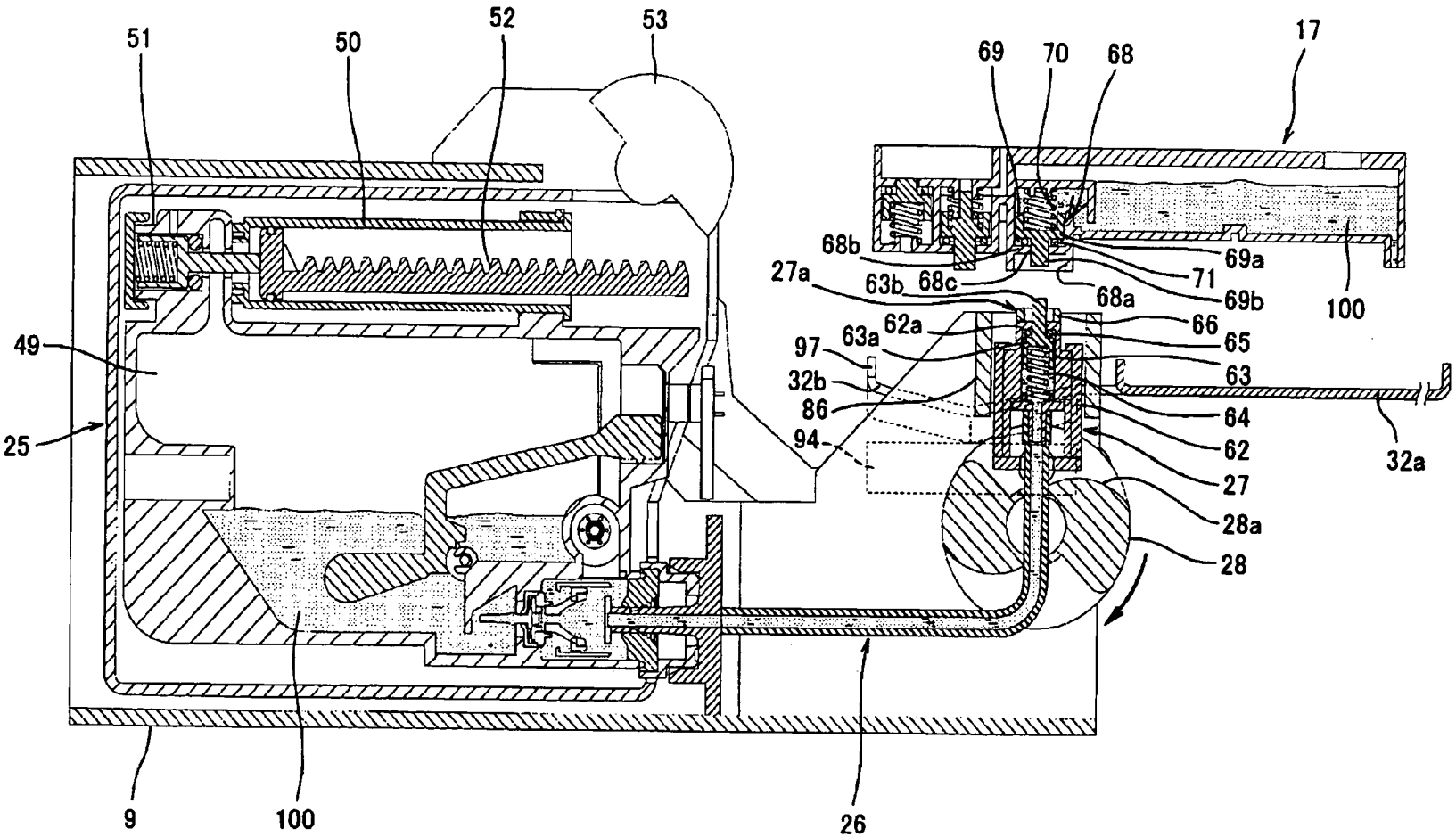
FIG. 9 shows a cross-sectional view of the ink jet recording device. A state is shown in which ink replenishment has been completed.

FIG. 9 shows a state in which the ink replenishment operation of the sub tank 17 has been completed. FIG. 9 corresponds to the same cross-section as FIG. 5. When the ink replenishment operation of the sub tank 17 has been completed, the cam roller 28 rotates in the clockwise direction, and the second joint part 27 is lowered. The lower surface of the first joint part 68 and the sealing member 66 of the second joint part 27 thus separate, and the shaft part 63*b* of the second opening and closing valve 63 and the shaft part 69*b* of the first opening and closing valve 69 thus separate. First, the base part 69*a* of the first opening and closing valve 69 fits with the sealing ring 71 due to the biasing force of the coiled spring 70, and the first opening and closing valve 69 is closed. That is, the ink path 72 of the first joint part 68 is closed. Next, the base part 63*a* of the second opening and closing valve 63 fits with the sealing ring 65 due to the biasing force of the coiled spring 64, and the second opening and closing valve 63 is closed. That is, the ink path 27*b* of the second joint part 27 is closed. The ink path 27*b* of the second joint part 27 is closed after the ink path 72 of the first joint part 68 has been closed. When the ink has been replenished in the sub tank 17, the image recording unit 15 moves in the scanning direction in response to a command from the head controlling substrate 18. The image recording unit 15 discharges ink onto paper 11 that is present in the printing region 14, thus recording an image on the paper 11.

When the ink has been replenished in the sub tank 17, ink may adhere to the ink inlet hole 68*a* of the sub tank 17 or the surroundings thereof. If the image recording unit 15 scans above the paper 11 in this state, the ink adhering to the ink inlet hole 68*a* may fall down due to gravity. With the configuration of the present embodiment, ink that falls from the ink inlet hole 68*a* is caught by the cover part 32*b*. As described above, this ink flows toward the ink storage tank 94 and is absorbed by the ink absorbing body 95. With the present embodiment, it is possible to prevent ink falling from the image recording unit 15 onto the paper 11. It is consequently possible to improve printing quality.

Further, the cover part 32*b* is configured integrally with the guide rail main body 32*a*. It is consequently not necessary to form the cover part 32*b* as a separate component, and the number of components can thereby be reduced. Further, there is no space present between the cover part 32*b* and the guide rail main body 32*a*. As a result, ink that has fallen from the sub tank 17 and ink that has rebounded from the cover part 32*b* does not make contact with the paper 11 via this space.

Second Embodiment

Figure 10:
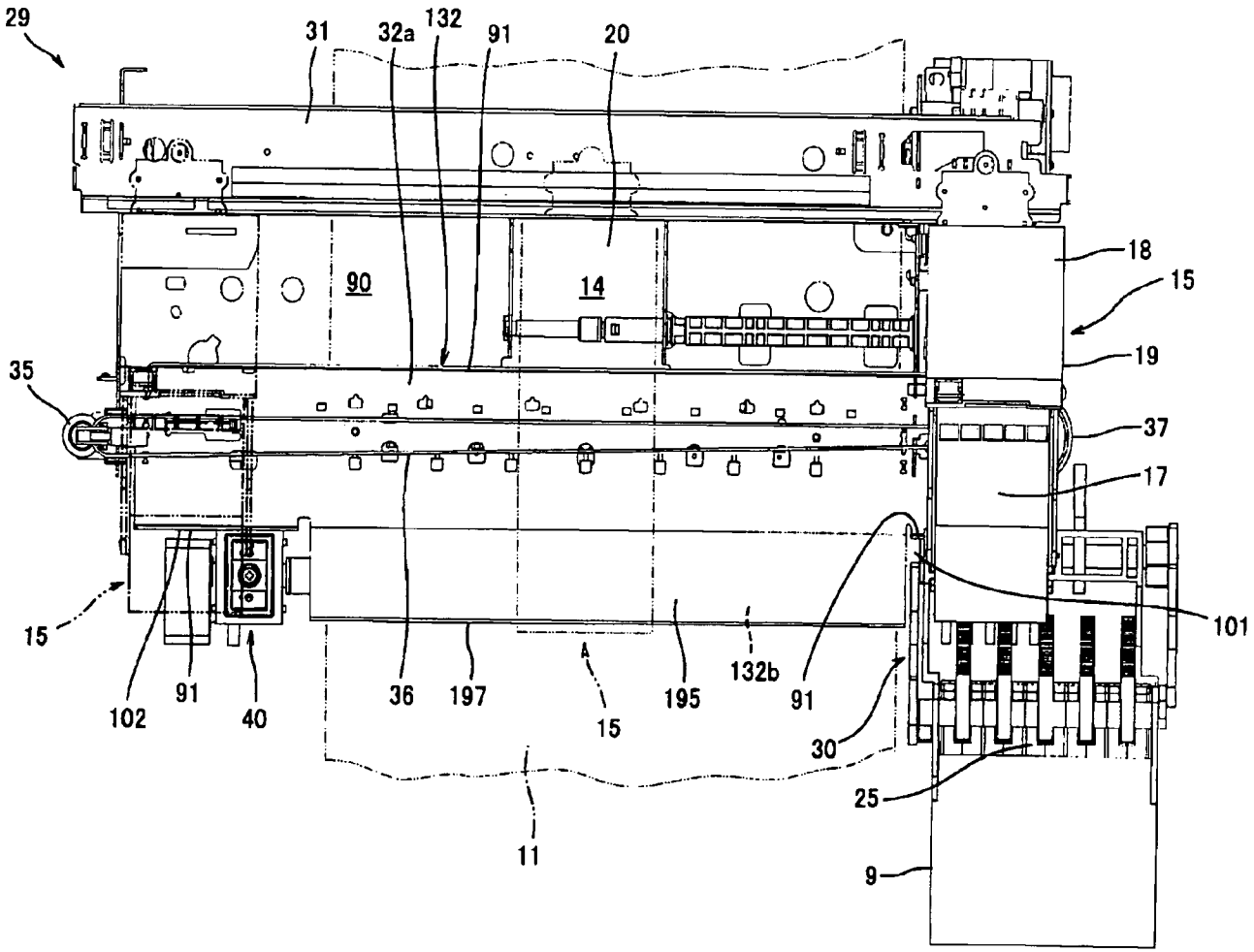
FIG. 10 shows a plan view of an ink jet recording device of another embodiment.
Figure 11:
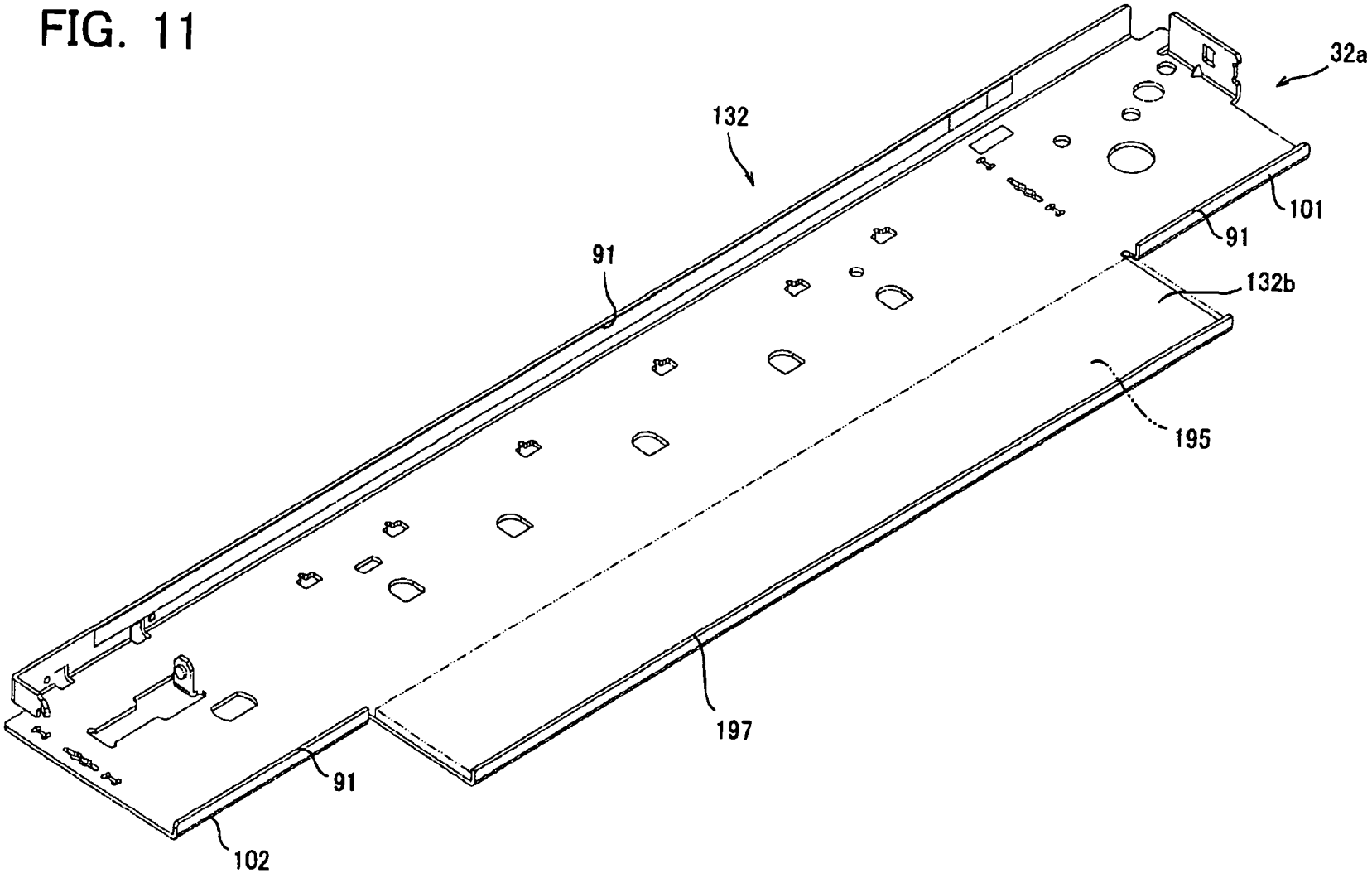
FIG. 11 shows a perspective view of a guide rail of another embodiment.

FIG. 10 shows a plan view of the ink jet recording device 3. FIG. 11 shows a perspective view of a guide rail 132 of a downstream side in the paper transferring direction. The shape of the guide rail 132 and a cover part 132*b* differ in the present embodiment from those of the first embodiment. Other points are the same as in the first embodiment. Moreover, the same reference numbers are applied to the component parts that have the same configuration as those in the first embodiment, and a description of those component parts is omitted.

The guide rail 132 comprises the guide rail main body 32*a* and the cover part 132*b*. The cover part 132*b* extends downstream, in the paper transferring direction, from a central part, in the scanning direction, of the guide rail main body 32*a*. The notches 101 and 102 are formed at the two ends, in the scanning direction, of the cover part 132*b*. Furthermore, the cover part 132*b* is disposed so as to cover, from above, the printing region 14 through which the paper 11 passes. The cover part 132*b* is disposed between the moving path of the first joint part 68 and the feeding path 12 of the paper 11 in the vertical direction. The cover part 132*b* extends along the scanning direction. An upper surface of the cover part 132*b* is formed so as to be horizontal. An ink absorbing body 195 is mounted on the upper surface of the cover part 132*b*. Almost of the upper surface of the cover part 132*b* is covered by the ink absorbing body 195. A peripheral end part of the cover part 132*b* that is downstream in the paper transferring direction extends upward (that is, a rising part 197 is formed).

Ink that has fallen from the ink inlet hole 68*a* of the first joint part 68 is caught by the cover part 132*b*, and the ink is absorbed by the ink absorbing body 195. It is thus possible to prevent the ink from making contact with the paper 11, and satisfactory printing quality can thus be maintained. Further, since the rising part 197 is present, ink that has rebounded from the cover part 132*b* or the ink absorbing body 195 is prevented from dispersing to the exterior of the cover part 132*b*.

In the present embodiment, the cover part 132*b* is formed in a flat shape. However, the cover part 132*b* may equally well have a shape such that ink flows toward an inner side of the cover part 132*b*. For example, the cover part 132*b* may be V shaped in vertical cross-section. In these configurations, the ink absorbing body 195 may be provided at a location to which the ink flows.

The technique set forth in the above embodiments may be applied to a liquid discharge device other than an ink jet recording device. For example, the technique set forth in the above embodiments may be applied to a device for discharging a solder to make a print circuit.

What is claimed is:

1. A liquid discharge device, comprising:

a transferring device that transfers a recording medium along a feeding path, a discharge head capable of moving along a movement path, the movement path disposed above the feeding path, the discharge head comprising a nozzle for discharging liquid toward the recording medium transferred by the transferring device;

a tank capable of moving along the movement path with the discharge head, the tank comprising a liquid inlet hole and a liquid outlet hole, the tank capable of storing liquid replenished from the liquid inlet hole, wherein the liquid within the tank is to be supplied to the discharge head via the liquid outlet hole;

a liquid replenishment device capable of being connected to and disconnected from the tank, wherein the liquid is supplied to the tank when the liquid replenishment device is in a connected state with the tank; and a member disposed between the feeding path and the movement path along a vertical direction, the member configured to receive liquid falling from the liquid inlet hole of the tank;

wherein the liquid inlet hole of the tank opens downward; and wherein, in a plan view of the liquid discharge device, the member overlaps with a movement range of the liquid inlet hole of the tank.

2. The liquid discharge device as in claim 1;

wherein the liquid replenishment device comprises a joint member and a movement device capable of moving the joint member in the vertical direction;

wherein the joint member comprises a liquid path opening upward; and wherein, in a case where the movement device moves the joint member upward, the joint member is connected to the tank.

3. The liquid discharge device as in claim 2;

wherein, in the plan view of the liquid discharge device, the joint member does not overlap with the feeding path.

4. The liquid discharge device as in claim 2;

wherein, in the plan view of the liquid discharge device, the joint member does not overlap with the member.

5. The liquid discharge device as in claim 1;

wherein, in a plan view of the liquid discharge device, the member does not overlap with a movement range of the nozzle of the discharge head.

6. The liquid discharge device as in claim 1;

wherein the member comprises a guide rail that guides the movement of the discharge head along the movement path.

7. The liquid discharge device as in claim 1;

wherein the member comprises a slant portion that slants downward.

8. The liquid discharge device as in claim 7, further comprising:

a liquid absorbing member;

wherein the slant portion slants downward toward the liquid absorbing member.

9. The liquid discharge device as in claim 1;

wherein at least a part of a peripheral portion of the member extends upward.

10. A liquid discharge device, comprising:

a transferring device that transfers a recording medium along a feeding path, a discharge head capable of moving along a movement path, the movement path disposed above the feeding path, the discharge head comprising a nozzle for discharging liquid toward the recording medium transferred by the transferring device;

a tank capable of moving along the movement path with the discharge head, the tank comprising a liquid inlet hole and a liquid outlet hole, the tank capable of storing liquid replenished from the liquid inlet hole, wherein the liquid within the tank is to be supplied to the discharge head via the liquid outlet hole;

a liquid replenishment device capable of being connected to and disconnected from the tank, wherein the liquid is supplied to the tank when the liquid replenishment device is in a connected state with the tank; and a member disposed between the feeding path and the movement path along a vertical direction, the member configured to receive liquid falling from the liquid inlet hole of the tank;

wherein the member comprises a guide rail that guides the movement of the discharge head along the movement path.

11. A liquid discharge device, comprising:

a transferring device that transfers a recording medium along a feeding path, a discharge head capable of moving along a movement path, the movement path disposed above the feeding path, the discharge head comprising a nozzle for discharging liquid toward the recording medium transferred by the transferring device;

a tank capable of moving along the movement path with the discharge head, the tank comprising a liquid inlet hole and a liquid outlet hole, the tank capable of storing liquid replenished from the liquid inlet hole, wherein the liquid within the tank is to be supplied to the discharge head via the liquid outlet hole;

a liquid replenishment device capable of being connected to and disconnected from the tank, wherein the liquid is supplied to the tank when the liquid replenishment device is in a connected state with the tank; and a member disposed between the feeding path and the movement path along a vertical direction, the member configured to receive liquid falling from the liquid inlet hole of the tank;

wherein the member comprises a slant portion that slants downward.

* * * * *